US011754015B2

(12) United States Patent
Jung

(10) Patent No.: US 11,754,015 B2
(45) Date of Patent: Sep. 12, 2023

(54) METHOD AND DEVICE FOR OPERATING AN INTERNAL COMBUSTION ENGINE AND CARRYING OUT A CORRECTION OF THE FUEL INJECTION QUANTITY BY CORRELATION OF A FUEL PRESSURE CHANGE

(71) Applicant: Vitesco Technologies GmbH, Regensburg (DE)

(72) Inventor: Uwe Jung, Wörth a. d. Donau (DE)

(73) Assignee: Vitesco Technologies GmbH, Regensburg (DE)

( * ) Notice: Subject to any disclaimer, the term of this patent is extended or adjusted under 35 U.S.C. 154(b) by 0 days.

(21) Appl. No.: 17/656,134

(22) Filed: Mar. 23, 2022

(65) Prior Publication Data

US 2022/0213845 A1 Jul. 7, 2022

Related U.S. Application Data

(63) Continuation of application No. PCT/EP2020/074562, filed on Sep. 3, 2020.

(30) Foreign Application Priority Data

Sep. 23, 2019 (DE) ..... 10 2019 214 458.6

(51) Int. Cl.
*F02D 41/40* (2006.01)
*F02D 41/14* (2006.01)
*F02D 41/22* (2006.01)

(52) U.S. Cl.
CPC ..... *F02D 41/402* (2013.01); *F02D 41/1402* (2013.01); *F02D 41/221* (2013.01);
(Continued)

(58) Field of Classification Search
CPC .... F02D 41/14; F02D 41/1402; F02D 41/221; F02D 41/402; F02D 2200/0602; F02D 2200/0614; F02D 2041/224
(Continued)

(56) References Cited

U.S. PATENT DOCUMENTS 10,495,018 B2 * 12/2019 Kim ..... F02D 41/247
2003/0209232 A1 * 11/2003 Hou ..... F02M 63/0225 123/464

(Continued)

FOREIGN PATENT DOCUMENTS

DE 102006009920 A1 9/2007
EP 2453123 A1 10/1987

(Continued)

OTHER PUBLICATIONS

International Search Report and Written Opinion dated Nov. 11, 2020 from corresponding International Patent Application No. PCT/EP2020/074562.

*Primary Examiner* — John Kwon
*Assistant Examiner* — Johnny H Hoang

(57) ABSTRACT

The disclosure relates to a method for operating an internal combustion engine which has at least one injector and in which a correction of fuel injection quantity is implemented. For the correction of the fuel injection quantity, different properties of the injector in the ballistic working range thereof and in the linear working range thereof are evaluated. A total injection quantity of the injector demanded in an operating cycle is divided into a number of smaller, equal partial injection quantities implemented as partial pulses, and an evaluation of the pressure drops triggered by the partial pulses is performed in the correction of the fuel injection quantity. The disclosure furthermore relates to a device for operating an internal combustion engine which
(Continued)

has at least one injector and in which a correction of the fuel injection quantity is implemented.

15 Claims, 7 Drawing Sheets

(52) U.S. Cl.
CPC ..... *F02D 2041/224* (2013.01); *F02D 2200/0602* (2013.01); *F02D 2200/0614* (2013.01)

(58) Field of Classification Search
USPC ..... 701/102–105
See application file for complete search history.

(56) References Cited

U.S. PATENT DOCUMENTS

| | | | | |
|---|---|---|---|---|
| 2009/0326788 | A1* | 12/2009 | Yuasa | F02M 63/0225 701/104 |
| 2012/0118053 | A1 | 5/2012 | Serra | |
| 2012/0123703 | A1 | 5/2012 | Serra | |
| 2013/0327297 | A1* | 12/2013 | Sgatti | F02M 69/50 123/456 |
| 2021/0254574 | A1 | 8/2021 | Uwe | |

FOREIGN PATENT DOCUMENTS

| | | | |
|---|---|---|---|
| EP | 2455605 | A1 | 5/2012 |
| EP | 2706216 | A1 | 3/2014 |
| WO | 2020094404 | A1 | 5/2020 |

* cited by examiner

METHOD AND DEVICE FOR OPERATING AN INTERNAL COMBUSTION ENGINE AND CARRYING OUT A CORRECTION OF THE FUEL INJECTION QUANTITY BY CORRELATION OF A FUEL PRESSURE CHANGE

CROSS-REFERENCE TO RELATED APPLICATIONS

This application claims the benefit of PCT Application PCT/EP2020/074562, filed Mar. 3, 2020, which claims priority to German Application 10 2019 214 458.6, filed Sep. 23, 2019. The disclosures of the above applications are incorporated herein by reference.

TECHNICAL FIELD

The present disclosure relates to a method and to a device for operating an internal combustion engine which has at least one injector and in which a correction of the fuel injection quantity is implemented.

BACKGROUND

During operation, internal combustion engines are subject to a certain amount of wear and to a change in their technical properties. In order to comply with legislation relating to emissions, narrow tolerances are to be maintained in the manufacture of the components. Any detection of the changes that occur during the service life allows the manufacturing tolerances to be widened and/or more advantageous materials to be used, which ultimately leads to a lower product price or increased profit. Alternatively, such detection algorithms can be used to achieve higher objectives in terms of performance and/or emissions.

Hitherto, detection algorithms based on sensor signals of the injector have been used for a fuel injection quantity correction. Electromechanical properties are used here to detect characteristic points in the behavior of the injector and to always set these temporally to the same value by closed-loop control. A disadvantage of this approach is that when detecting the opening behavior of the injector, the conventional actuation signal typically cannot be used. A transfer from detection-based to operational actuation is necessary.

Furthermore, it is already known for a conclusion pertaining to the quantity of injected fuel to be drawn based on a measured press drop in the rail, or in the supply line, respectively.

In systems implemented today, a full-load quantity deviation is in most cases reflected in an offset correction of the lambda controller, wherein no distinction is however made between an air error and a fuel error.

SUMMARY

The disclosure provides a method for operating an internal combustion engine which has at least one injector and in which a correction of the fuel injection quantity can take place without using additional sensor hardware.

One aspect of the disclosure provides a method for operating an internal combustion engine which has at least one injector and in which a correction of fuel injection quantity is implemented. For the correction of the fuel injection quantity, different properties of the injector in the ballistic working range thereof and in the linear working range thereof are evaluated. A total injection quantity of the injector demanded in an operating cycle is divided into a number of smaller, identical partial injection quantities implemented as partial pulses, and an evaluation of the pressure drops triggered by the partial pulses is performed in the correction of the fuel injection quantity.

Implementations of the disclosure may include one or more of the following optional features. In some implementations, an error in the opening behavior of the injector in the ballistic working range of the injector is detected.

In some examples, the pressure drop triggered by a partial pulse is measured and the sum of the pressure drops triggered by the partial pulses is determined.

The pressure drop triggered by each partial pulse may be measured and the sum of the pressure drops triggered by the partial pulses may be determined.

In some implementations, the determined sum of the pressure drops triggered by the partial pulses is compared with a stored nominal pressure drop for the required total injection quantity. An error in the opening behavior of the injector may be determined according to the following correlation: $dm_o=[dm_X-dm_{XE}]/i=[(\rho(p,T)*V/B_s(p,T))*(dp_X-dp_{i,m})]/i$.

In some examples, an error in the flow behavior of the injector in the linear working range of the injector is detected. The detected error in the flow behavior of the injector may be determined according to the following correlation: $dm_d=dm_X-(dm_{x,r}-dm_{XE})=(\rho(p,T)*V/B_s(p,T))*(dp_X-(dp_{x,m}-dp_{i,m}))$.

In some implementations, errors in the opening behavior and in the flow behavior of the injector are in each case determined for a plurality of different total injection quantities and respective associated different partial injection quantities.

In some examples, a required offset correction for an operating point of the injector is performed by adapting the control duration of a determined characteristic curve to a predefined nominal characteristic curve.

A deviation of the gradient of a determined fuel injection quantity characteristic curve in relation to a nominal fuel injection quantity characteristic curve may be determined, and the determined deviation may be corrected by a gradient correction of the determined fuel injection quantity characteristic curve. In some examples, the correction for the ballistic working range and for the linear working range of the injector takes place separately.

Another aspect of the disclosure provides a device for carrying out the method described above. The device having control unit which is configured for controlling the method.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

The disclosure relates to a method and to a device for operating an internal combustion engine which has at least one injector and in which a correction of fuel injection quantity is implemented.

Figure 1:
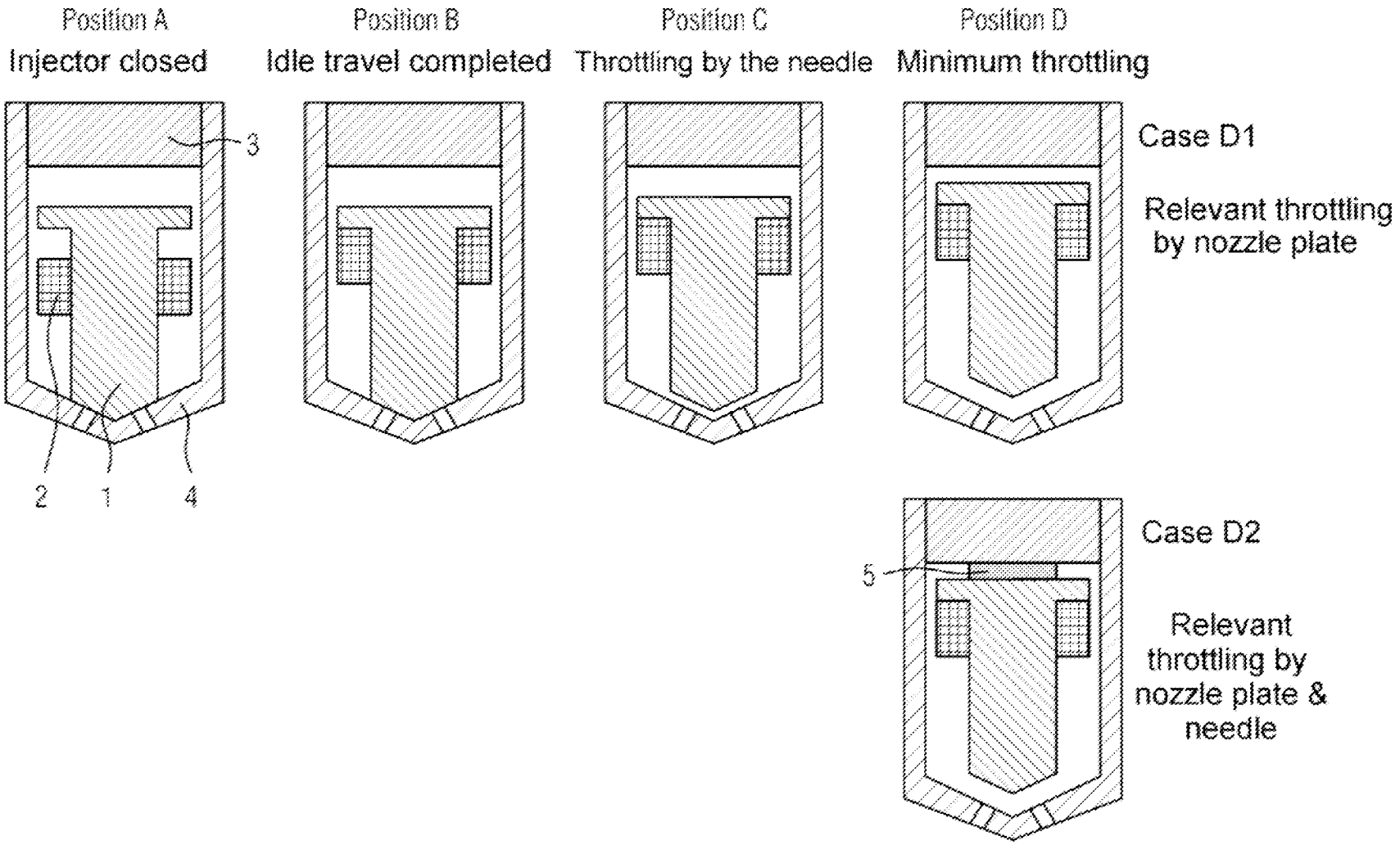
FIG. 1 shows a schematic illustration of five opening phases of an injector.

The disclosure utilizes the different properties of an injector in the ballistic operation (needle stop or maximum flow is not reached=position A–C in FIG. 1) and in the linear range (needle stop or maximum flow is reliably reached, position D in FIG. 1). FIG. 1 shows different opening phases of an injector having a nozzle needle 1, an armature 2, a magnet coil 3, a nozzle plate 4, and a mechanical stop 5. FIG. 1 is merely a schematic illustration in which no springs, guides, etc. are shown.

For the sake of simplicity, only a decrease in the fuel injection quantity (broken lines) relative to the normal quantity (solid lines) is shown in the following figures. However, all the following statements also apply analogously to an increase in the quantity.

Figure 2:
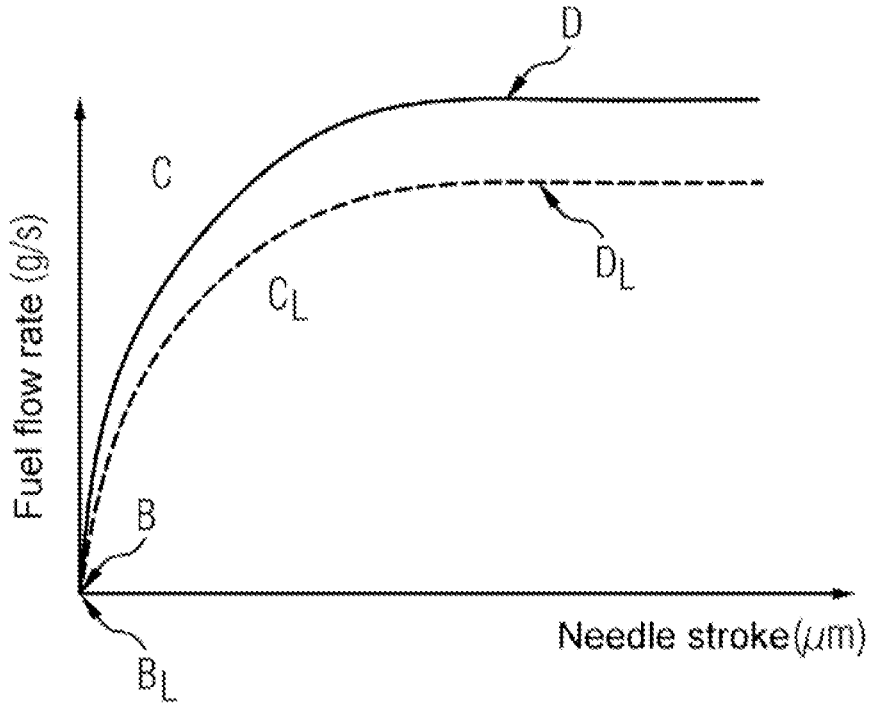
FIG. 2 shows a diagram of the flow through an injector as a function of the needle stroke.

A fundamental wear/tolerance point for an injector is the idle travel of the armature 2 thereof that can be seen by comparing the position A and the position B in FIG. 1. A changed idle travel of the armature in principle represents a temporal offset of the injection quantity characteristic curve shown in FIG. 4 and of the fuel injection rate start shown in FIG. 3, as can be seen from a comparison of the points B and $B_L$ in FIG. 3. In contrast, a changed idle travel of the armature cannot be seen from the illustration of the injector flow over the stroke of the nozzle needle shown in FIG. 2, because the points B and $B_L$ have the same location.

A further substantial wear/tolerance point for an injector is the maximum flow of the latter (cf. position D in FIG. 1). The flow of an injector is changeable by virtue of potential tolerances/wear of the nozzle plate 4 of the injector, shown in FIG. 1, or by virtue of tolerances/wear of the stop 5 of the injector, shown in FIG. 1. A change in the maximum flow of the injector in principle represents a gradient change in the flow quantity characteristic curve, shown in FIG. 4, and a changed maximum injection rate, as can be seen from a comparison of the points D and $D_L$ in FIG. 3. By way of example, a reduction in the injection rate is illustrated therein. A changed injector flow can also be seen in the illustration of the injector flow over the stroke of the nozzle needle, shown in FIG. 2, as is visualized by a comparison of the points D and $D_L$.

The method according to the disclosure utilizes this behavior. If the working range of the injector is in the linear range, the algorithm can be started. This is practically already the case at very low engine loads, so that the detection can be applied practically without limitations.

Figure 6:
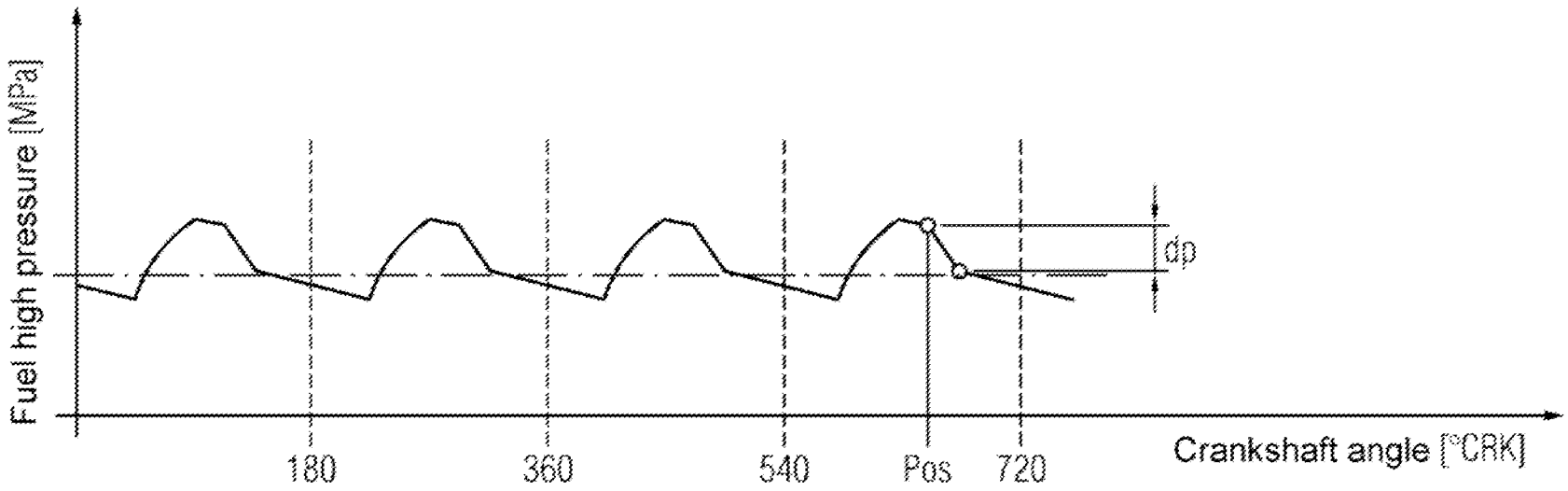
FIG. 6 shows a diagram of the fuel high pressure as a function of the crankshaft angle.
Figure 7:
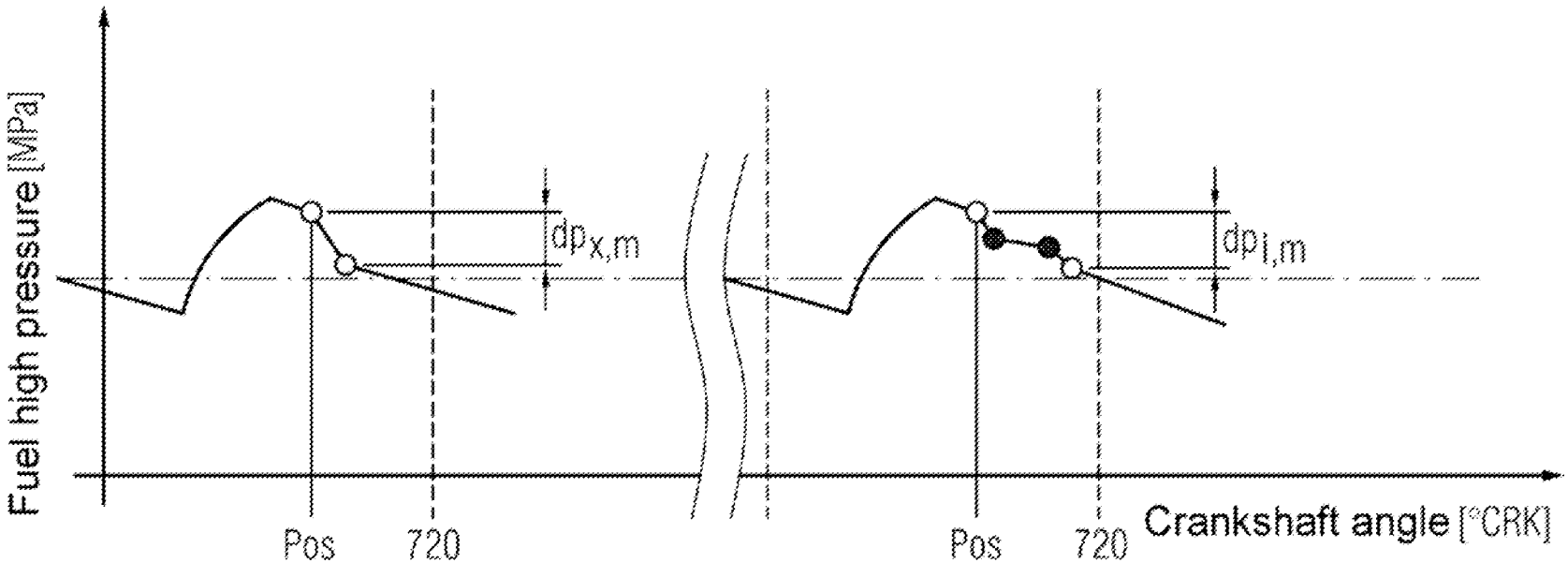
FIG. 7 shows a more detailed diagram of the fuel high pressure as a function of the crankshaft angle.

A total fuel injection quantity X demanded in an operating cycle of the injector is generally provided by a single injection pulse. Ideally, this injection is already corrected in such a manner that the injector closing event corresponds to its nominal value (cf. point S in FIG. 3). The executed single injection pulse should trigger a pressure drop that is expected, and is to be measured, in terms of the position and magnitude (cf. dp and Pos in FIG. 6).

The physical correlation is described by the equation:

$$dm = \frac{\rho(p, T) * V}{B_s(p, T)} * dp$$

where the following definitions apply: dm is the fuel mass extracted from the system; dp is the pressure drop in the system; V is the pressurized system volume; ρ(p,T) is the fuel density, and $B_s$(p,T) is the bulk modulus of the fuel.

The fuel density and the bulk modulus of the fuel are stored in the control unit software as characteristic maps as a function of the measured or modeled variables of pressure and temperature. Optionally, a direct measurement while using suitable sensors is also possible. The system volume is a known constant.

In the best case, with a known density and bulk modulus, a measured pressure drop indicates the mass of the injection pulse to be implemented. No correction is required in this case. However, if the result deviates from this best case, the injector has an error in its flow behavior and/or in its opening behavior (cf. D to $D_L$ in FIG. 3, and B/C to $B_L/C_L$ in FIG. 3).

Figure 5:
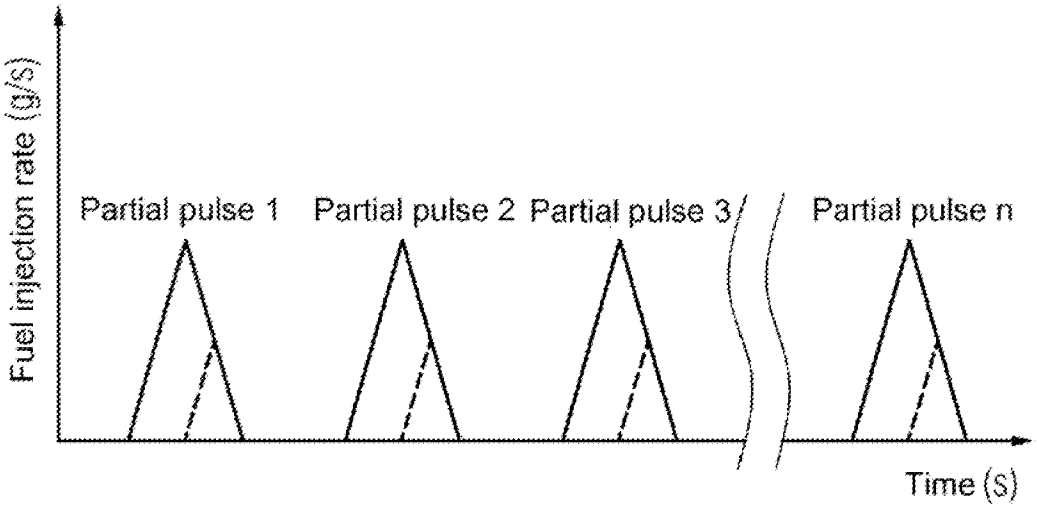
FIG. 5 shows a diagram of the fuel injection rate as a function of time on the left, and the fuel injection rate as a function of time for individual partial pulses on the right.
Figure 5:
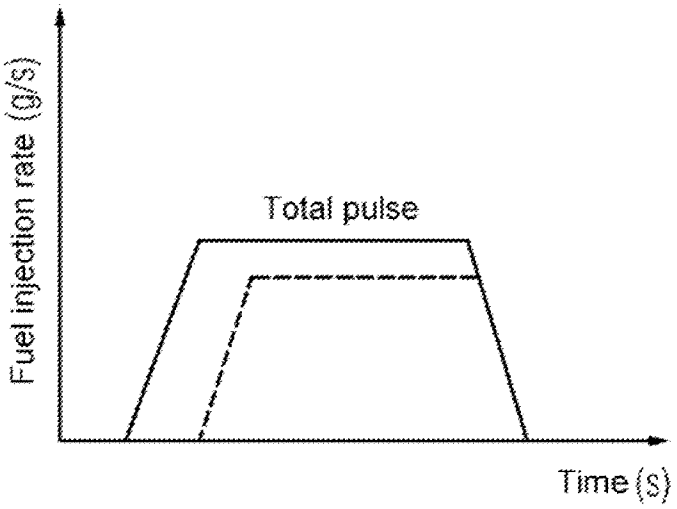

According to the disclosure, in a first step, a distinction is made between errors in the flow behavior and errors in the opening behavior. For this purpose, the demanded total injection quantity is divided into a number n of smaller, identical quantity pulses or partial pulses XE with the same total quantity. It is important here that the small quantity pulses are implemented in the ballistic injector operation. By virtue of the solely ballistic pulses, any potential flow error is ineffective (cf. FIG. 5).

Figure 3:
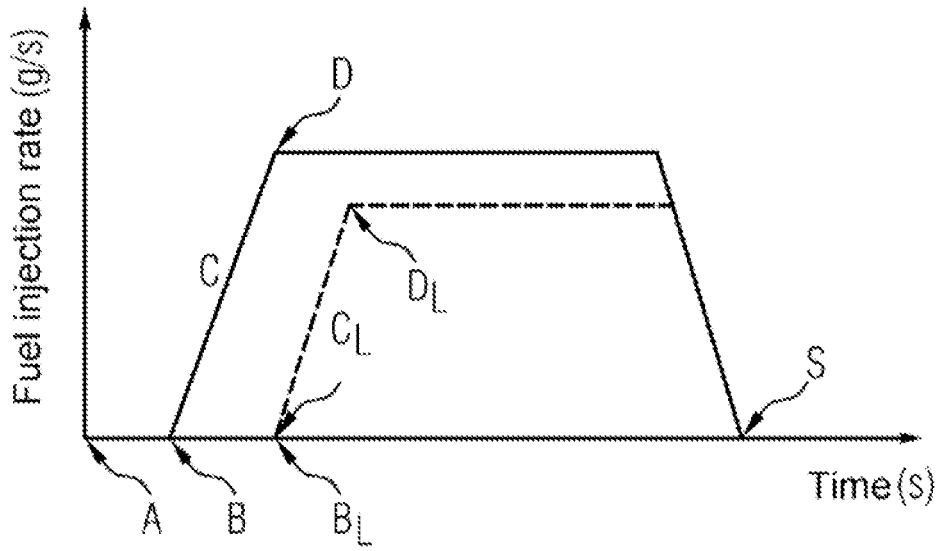
FIG. 3 shows a diagram of the fuel injection rate of the injector as a function of time.
Figure 4:
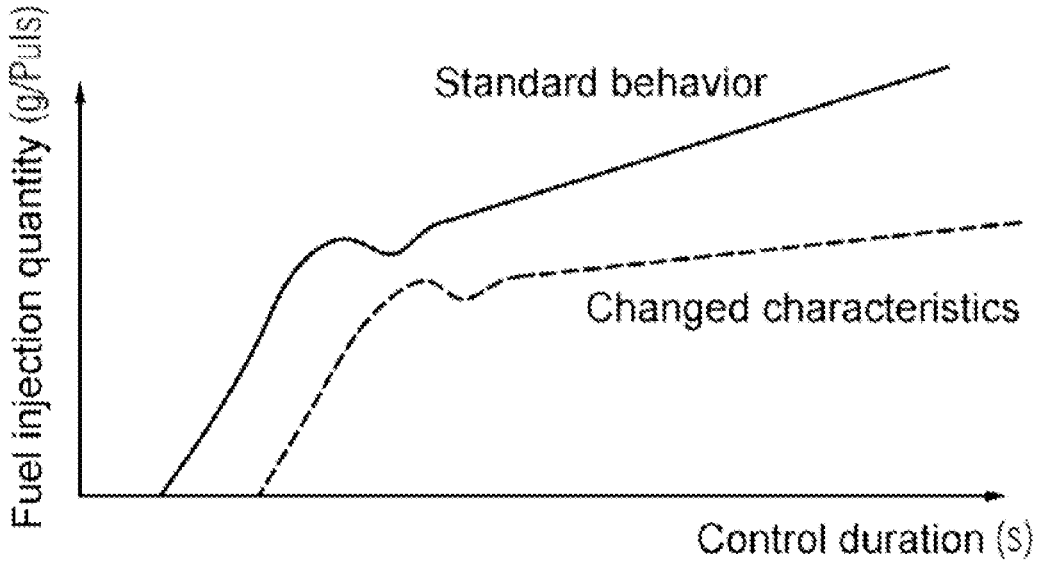
FIG. 4 shows a diagram of the fuel injection rate of the injector as a function of the control duration.

In the example considered here, the implemented injection quantity is too low due to the opening error (B/C to $B_L/C_L$ in FIG. 3). Without opening errors, the sum of the pressure drops of the partial pulses would be equal to an expected pressure drop when using a single pulse. i.e. the deviation in relation to the expected pressure value is the sum of the opening error.

If $dp_X$ is the theoretical pressure drop that would result in the case of use of a single pulse X with the theoretical mass $dm_x$, and $dp_{i,m}$ is the measured pressure drop that results at the number i in the sequence of all smaller pulses XE with the mass $dm_{XE,i}$ and the total mass $dm_{XE}$, then the quantity error of the opening is described by the following correlation:

$$dm_o = [dm_X - dm_{XE}]/i = [(\rho(p, T)^* V/B_s(p, T))^*(dp_X - dp_{i,m})]/i.$$

The pressure drop $dp_{x,m}$ in the case of the real, erroneous mass $dm_{x,r}$ being dispensed as a single pulse in linear injector operation is additionally considered. The quantity error resulting from flow deviations can then be determined from this:

$$dm_d = dm_X - (dm_{x,r} - dm_{XE}) = (\rho(p, T)^* V/B_s(p, T))^* (dp_X - (dp_{x,m} - dp_{i,m})).$$

Figure 8:
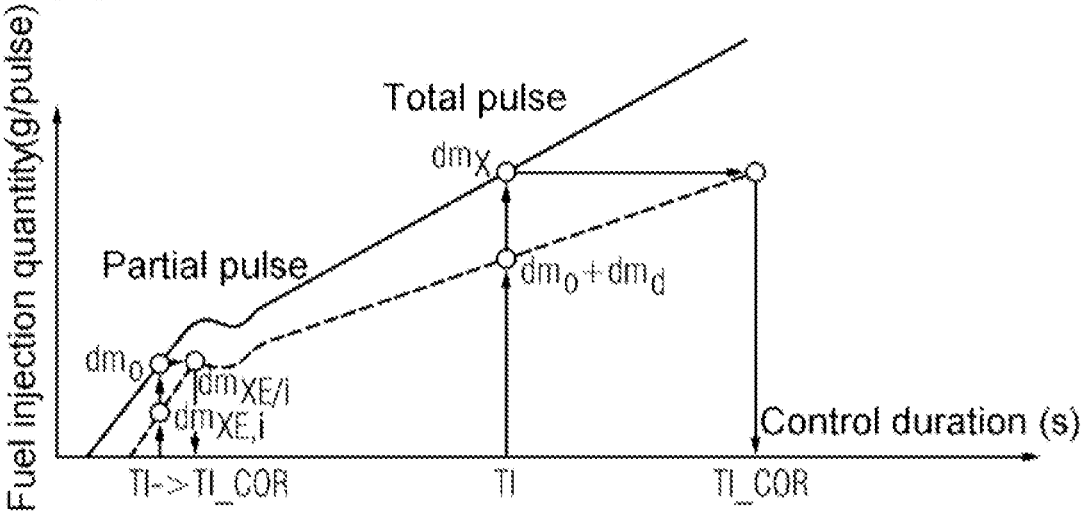
FIG. 8 shows a diagram of the fuel injection quantity as a function of the control duration.

By measurements at different quantity points X and XE, the deficit $d_{mo}$ and $d_{md}$ can be determined in each case. The offset correction TI→TI_COR required for each point results from the transfer of the determined characteristic curve to the nominal (cf. FIG. 8).

Figure 9:
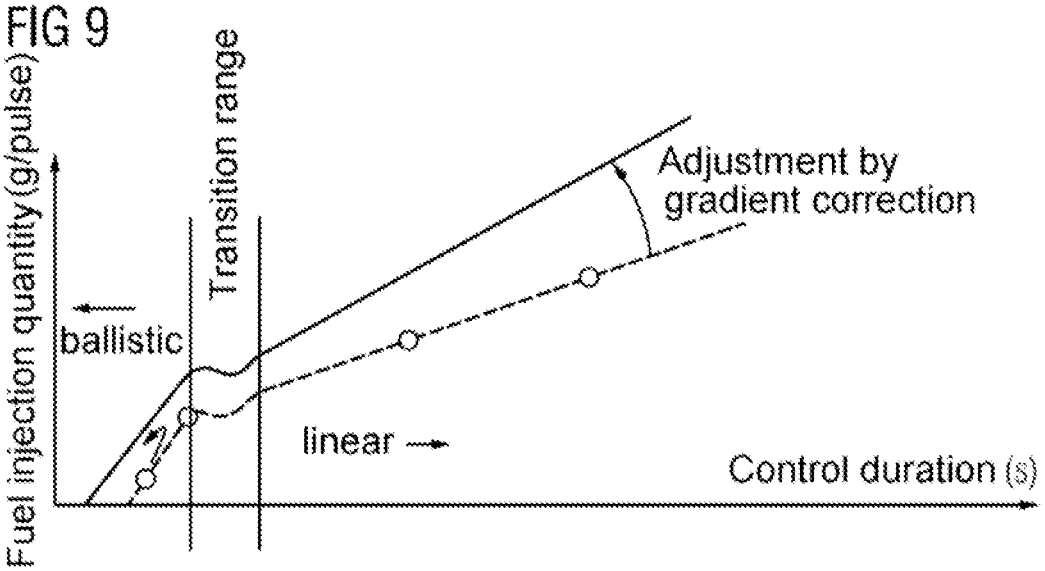
FIG. 9 shows a diagram of the fuel injection quantity as a function of the control duration and the adjustment by gradient correction.

For a "fast" correction, the process can be repeated for more than two different quantities/actuation times, and in this way the deviation of the gradient can be calculated and corrected in each case separately for the ballistic range of the characteristic curve and the linear range of the characteristic curve (cf. FIG. 9). The transient range between the ballistic range and the linear range is omitted here and is no longer used for the operation, because the quantities arising there can be realized linearly or ballistically in any case.

If the entire method is performed for a plurality of different operating points and the frequency distribution of the determined corrections is taken into account, the detection precision is increased significantly in this instance.

The present disclosure makes it possible, by utilizing the properties of the injector in terms of its ballistic and its linear behavior, to implement an opening detection without additional sensor hardware and a determination of the flow error of the injector. A differentiation between air and fuel errors in the lambda control can furthermore take place. This allows not only an improved injection quantity tolerance but also narrower diagnosis limits and/or higher reliability of the lambda diagnosis, including an improvement in pin-pointing in the event of an error.

Furthermore, the method described above represents an alternative detection method for injector opening behavior.

When opening detection by sensors is used, the method described above permits plausibilization of the detection by sensors. A prerequisite in all cases is the use of injector closing point control such as, for example, a control according to the known COSI (controlled solenoid injection) method.

The method described above is controlled by a control unit which is configured for controlling the method described above.

A number of implementations have been described. Nevertheless, it will be understood that various modifications may be made without departing from the spirit and scope of the disclosure. Accordingly, other implementations are within the scope of the following claims.

What is claimed is:

1. A method for operating an internal combustion engine having at least one injector, the method comprising:

evaluating different properties of the at least one injector in a ballistic working range and in a linear working range;

dividing a total injection quantity of the injector demanded in an operating cycle into a number of smaller, identical partial injection quantities;

implementing the number of smaller, identical partial injection quantities as partial pulses;

detecting an error in an opening behavior of the injector in the ballistic working range of the injector;

measuring a pressure drop triggered by each partial pulse;

determining a sum of the pressure drops triggered by the partial pulses;

comparing a sum of the pressure drops triggered by each partial pulse with a stored nominal pressure drop for a required total injection quantity; and implementing a correction of a fuel injection quantity based on pressure drops triggered by the partial pulses;

wherein the error in the opening behavior of the injector is determined based on a difference between an expected pressure drop $dp_X$ of a single pulse X with a mass $dm_x$ and a measured pressure drop $dp_{i,m}$ that results at the number i in a sequence of all partial pulses XE with a mass $dm_{XE,i}$ and a total mass $dm_{XE}$, as well as based on a fuel density ρ(p,T), a pressurized system volume V, and a bulk modulus $B_s$(p,T) of the fuel.

2. The method of claim 1, further comprising:

measuring the pressure drop triggered by a partial pulse; and determining a sum of the pressure drops triggered by the partial pulses.

3. The method of claim 1, wherein the error in the opening behavior of the injector is determined according to the following correlation:

$$dm_o = [dm_X - dm_{XE}]/i = [(\rho(p, T)^* V/B_s(p, T))^* (dp_X - dp_{i,m})]/i,$$

4. The method of claim 1, further comprising:

detecting an error in a flow behavior of the injector in the linear working range of the injector.

5. The method of claim 1, further comprising:

determining errors in an opening behavior and in a flow behavior of the injector for a plurality of different total injection quantities and respective associated different partial injection quantities.

6. The method of claim 1, further comprising:

performing an offset correction for an operating point of the injector is by adapting a control duration of a determined characteristic curve to a predefined nominal characteristic curve.

7. The method of claim 6, further comprising:

determining a deviation of a gradient of a determined fuel injection quantity characteristic curve in relation to a nominal fuel injection quantity characteristic curve; and correcting the determined deviation by a gradient correction of the determined fuel injection quantity characteristic curve.

8. The method of claim 7, wherein the correction for the ballistic working range and for the linear working range of the injector takes place separately.

9. A method for operating an internal combustion engine having at least one injector, the method comprising:

evaluating different properties of the at least one injector in a ballistic working range and in a linear working range;

dividing a total injection quantity of the injector demanded in an operating cycle into a number of smaller, identical partial injection quantities;

implementing the number of smaller, identical partial injection quantities as partial pulses;

detecting an error in an opening behavior of the injector in the ballistic working range of the injector;

detecting an error in a flow behavior of the injector in the linear working range of the injector; and implementing a correction of a fuel injection quantity based on pressure drops triggered by the partial pulses, wherein the error in the flow behavior of the injector is determined based on a difference between a theoretical pressure drop $dp_X$ of a single pulse X with a mass $dm_x$ and a difference between a pressure drop $dp_{x,m}$ in the case of a real, erroneous mass $dm_{x,r}$ being dispensed as a single pulse in linear injector operation and a measured pressure drop $dp_{i,m}$ that results at the number i in a sequence of all partial pulses XE with a mass $dm_{XE,i}$, and a total mass $dm_{XE}$, and based on a fuel density $\rho(p,T)$, a pressurized system volume V, and a bulk modulus $B_s(p,T)$ of the fuel.

10. A device for carrying out a method for operating an internal combustion engine having at least one injector, the device comprising:

a control unit configured for controlling the method for operating an internal combustion engine having at least one injector, the method comprising:

evaluating different properties of the at least one injector in a ballistic working range and in a linear working range;

dividing a total injection quantity of the injector demanded in an operating cycle into a number of smaller, identical partial injection quantities;

implementing the number of smaller, identical partial injection quantities as partial pulses;

detecting an error in an opening behavior of the injector in the ballistic working range of the injector;

detecting an error in a flow behavior of the injector in the linear working range of the injector; and implementing a correction of a fuel injection quantity based on pressure drops triggered by the partial pulses;

wherein the error in the flow behavior of the injector is determined based on a difference between a theoretical pressure drop $dp_X$ of a single pulse X with a mass $dm_x$ and a difference between a pressure drop $dp_{x,m}$ in the case of a real, erroneous mass $dm_{x,r}$ being dispensed as a single pulse in linear injector operation and a measured pressure drop $dp_{i,m}$ that results at the number i in a sequence of all partial pulses XE with a mass $dm_{XE,i}$, and a total mass $dm_{XE}$, and based on a fuel density $\rho(p,T)$, a pressurized system volume V, and a bulk modulus $B_s(p,T)$ of the fuel.

11. The device of claim 10, wherein the method further comprises:

measuring the pressure drop triggered by a partial pulse; and determining a sum of the pressure drops triggered by the partial pulses.

12. The device of claim 10, wherein the method further comprises:

measuring the pressure drop triggered by each partial pulse; and determining a sum of the pressure drops triggered by the partial pulses.

13. The device of claim 12, wherein the method further comprises:

comparing a sum of the pressure drops triggered by each partial pulse with a stored nominal pressure drop for the required total injection quantity.

14. The device of claim 10, wherein the error in the flow behavior of the injector is determined according to the following correlation:

$$dm_d = dm_X - (dm_{x,r} - dm_{XE}) = (\rho(p,T)^* V / B_s(p,T))^* (dp_X - (dp_{x,m} - dp_{i,m})),$$

15. A device for carrying out a method for operating an internal combustion engine having at least one injector, the device comprising:

a control unit configured for controlling the method for operating an internal combustion engine having at least one injector, the method comprising:

evaluating different properties of the at least one injector in a ballistic working range and in a linear working range;

dividing a total injection quantity of the injector demanded in an operating cycle into a number of smaller, identical partial injection quantities;

implementing the number of smaller, identical partial injection quantities as partial pulses; and implementing a correction of a fuel injection quantity based on pressure drops triggered by the partial pulses;

detecting an error in an opening behavior of the injector in the ballistic working range of the injector;

measuring the pressure drop triggered by each partial pulse;

determining a sum of the pressure drops triggered by the partial pulses;

comparing a sum of the pressure drops triggered by each partial pulse with a stored nominal pressure drop for the required total injection quantity, wherein the error in the opening behavior of the injector is determined based on a difference between an expected pressure drop $dp_X$ of a single pulse X with a mass $dm_x$ and a measured pressure drop $dp_{i,m}$ that results at the number i in a sequence of all partial pulses XE with a mass $dm_{XE,i}$ and a total mass $dm_{XE}$, as well as based on a fuel density $\rho(p,T)$, a pressurized system volume V, and a bulk modulus $B_s(p,T)$ of the fuel.

* * * * *